US010186205B2

(12) United States Patent
Tseng

(10) Patent No.: US 10,186,205 B2
(45) Date of Patent: Jan. 22, 2019

(54) DISPLAY PANEL, SOURCE DRIVING CIRCUIT AND DEVICE

(71) Applicant: BOE Technology Group Co., Ltd., Beijing (CN)

(72) Inventor: Szu Heng Tseng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/512,257

(22) PCT Filed: Apr. 14, 2016

(86) PCT No.: PCT/CN2016/079254
§ 371 (c)(1),
(2) Date: Mar. 17, 2017

(87) PCT Pub. No.: WO2016/184279
PCT Pub. Date: Nov. 24, 2016

(65) Prior Publication Data

US 2017/0287405 A1 Oct. 5, 2017

(30) Foreign Application Priority Data

May 15, 2015 (CN) ..... 2015 1 0250469

(51) Int. Cl.
*G09G 3/3275* (2016.01)
*G09G 3/3225* (2016.01)
*G09G 3/32* (2016.01)

(52) U.S. Cl.
CPC ..... *G09G 3/3275* (2013.01); *G09G 3/32* (2013.01); *G09G 3/3225* (2013.01);
(Continued)

(58) Field of Classification Search
CPC ..... G09G 3/3275; G09G 3/3225; G09G 2320/043; G09G 2310/027; G09G 2330/021; G09G 2310/0291
See application file for complete search history.

(56) References Cited

U.S. PATENT DOCUMENTS 7,663,439 B2 * 2/2010 Chang ..... H03F 1/086 330/255
8,830,155 B2 9/2014 Hsu et al.
(Continued)

FOREIGN PATENT DOCUMENTS

CN 101330203 A 12/2008
CN 101425806 A 5/2009
(Continued)

OTHER PUBLICATIONS

International Search Report (English translation) and Written Opinion of International Application No. PCT/CN2016/079254, dated Jun. 28, 2016, 9 pages.
(Continued)

*Primary Examiner* — Kwang-Su Yang
(74) *Attorney, Agent, or Firm* — Westman, Champlin & Koehler, P.A.

(57) ABSTRACT

The present disclosure provides a source driving circuit, a source driving device, a display panel and a display apparatus, which relate to the field of display technology, and can solve the problem that the conventional source driving circuit has large power consumption and a short lifetime. The source driving circuit according to the present disclosure comprises: a first operational amplifier and an output selection unit, wherein the first operational amplifier has a non-inverting input terminal configured to receive an analog data voltage signal, an inverting input terminal connected to an output terminal thereof, and the output terminal further connected to a data voltage signal input terminal of the
(Continued)

output selection unit, and the first operational amplifier is configured to amplify the analog data voltage signal; and the output selection unit further has a reference voltage signal input terminal and a selection control signal input terminal, and the output selection unit is configured to selectively output the amplified analog data voltage signal and a reference voltage signal input from the reference voltage signal input terminal to a data line under the control of a selection control signal input from the selection control signal input terminal.

15 Claims, 3 Drawing Sheets

(52) U.S. Cl.
CPC ..... *G09G 2310/027* (2013.01); *G09G 2310/0291* (2013.01); *G09G 2320/043* (2013.01); *G09G 2330/021* (2013.01)

(56) References Cited

U.S. PATENT DOCUMENTS

| | | | | |
|---|---|---|---|---|
| 9,171,518 | B2 * | 10/2015 | Tu | G09G 3/3688 |
| 9,293,095 | B2 | 3/2016 | Hsu et al. | |
| 2006/0109227 | A1 | 5/2006 | Park | |
| 2007/0120780 | A1 | 5/2007 | Park et al. | |
| 2010/0177066 | A1 | 7/2010 | Huang | |
| 2010/0245325 | A1 * | 9/2010 | Xiao | G09G 3/3688 345/211 |
| 2011/0310080 | A1 | 12/2011 | Tonomura | |
| 2012/0293476 | A1 * | 11/2012 | Lee | G09G 3/3614 345/209 |
| 2013/0257830 | A1 | 10/2013 | Kadota | |
| 2014/0285406 | A1 | 9/2014 | Kimura et al. | |
| 2014/0285537 | A1 | 9/2014 | Kimura et al. | |

FOREIGN PATENT DOCUMENTS

| | | | |
|---|---|---|---|
| CN | 101847390 | A | 9/2010 |
| CN | 102298897 | A | 12/2011 |
| CN | 102592527 | A | 7/2012 |
| CN | 103366664 | A | 10/2013 |
| CN | 103700351 | A | 4/2014 |
| CN | 104064137 | A | 9/2014 |
| CN | 104064138 | A | 9/2014 |
| CN | 104809984 | A | 7/2015 |

OTHER PUBLICATIONS

English translation of Box No. V of the Written Opinion for the International Searching Authority for International Application No. PCT/CN2016/079254, 2 pages.

* cited by examiner

DISPLAY PANEL, SOURCE DRIVING CIRCUIT AND DEVICE

CROSS-REFERENCE TO RELATED APPLICATION(S)

This application is a Section 371 National Stage Application of International Application No. PCT/CN2016/079254, filed on Apr. 14, 2016, which published as WO 2016/184279 A1, on Nov. 24, 2016, and claims priority to the Chinese Patent Application No. 201510250469.5, filed on May 5, 2015, entitled "SOURCE DRIVING CIRCUITS, SOURCE DRIVING DEVICES, DISPLAY PANELS AND DISPLAY DEVICES" which are incorporated herein by reference in their entirety.

TECHNICAL FIELD

The present disclosure relates to the field of display technology, and more particularly, to source driving circuits, source driving devices, display panels, and display devices.

BACKGROUND

Compared with Thin Film Transistor-Liquid Crystal Displays (TFT-LCD), which area current mainstream display technology, Organic Light-Emitting Diode (OLED) displays have advantages such as wide viewing angle, high brightness, high contrast, low power consumption, lighter weight and thinner profile, etc., and thus become the focus for the current flat panel display technology.

An OLED display device is typically comprised of an OLED display panel and a peripheral circuit for driving the OLED display panel. The OLED display panel comprises a plurality of gate lines and a plurality of data lines which are cross-arranged, and the plurality of gate lines and the plurality of data lines intersect with each other to define a plurality of pixel units. The peripheral circuit comprises a source driving chip and a gate driving chip. Specifically, the gate driving chip scans a pixel unit connected to a gate line through the gate line, and the source driving chip charges and discharges a pixel unit connected to a data line through the data line.

FIG. 1 is an internal circuit diagram of a conventional source driving chip having a compensation function. The circuit comprises a digital-to-analog converter DAC, an output selection unit MUX, and an operational amplifier OP, wherein the digital-to-analog converter DAC has one terminal configured to receive a digital data voltage signal data, and the other terminal connected to a data voltage signal input terminal of the output selection unit MUX. The digital-to-analog converter DAC is configured to convert the digital data voltage signal data into an analog data voltage signal, and transfer the analog data voltage signal to the output selection unit MUX. The output selection unit MUX further has a reference voltage signal input terminal, is further connected to a selection control line and the operational amplifier OP, and is configured to output the analog data voltage signal or a reference voltage signal input from the reference voltage signal input terminal to the operational amplifier OP under the control of a selection control signal SEL input through the selection control line. The operational amplifier OP is configured to amplify the input voltage signal and then output the amplified voltage signal to a data line.

The inventors have found that there are at least the following problems in conventional solutions: both the analog data voltage signal and the reference voltage signal are amplified by the operational amplifier OP, which causes the operational amplifier OP to consume large power and generate a lot of heat, thereby resulting in that the source driving chip has excessive high temperature and a shortened lifetime.

SUMMARY

In view of the above-described problem for the conventional source driving chip, the technical problem to be solved by the present disclosure is to provide a source driving circuit with low power consumption and a long lifetime, a source driving device comprising the source driving circuit, a display panel comprising the source driving device, and a display device comprising the display panel.

The technical solutions for solving the technical problem of the present disclosure are to provide a source driving circuit, comprising a first operational amplifier and an output selection unit, wherein the first operational amplifier has a non-inverting input terminal configured to receive an analog data voltage signal, an inverting input terminal connected to an output terminal thereof, and the output terminal further connected to a data voltage signal input terminal of the output selection unit, and the first operational amplifier is configured to amplify the analog data voltage signal; and the output selection unit further has a reference voltage signal input terminal and a selection control signal input terminal, and the output selection unit is configured to selectively output the amplified analog data voltage signal and a reference voltage signal input from the reference voltage signal input terminal to a data line under the control of a selection control signal input from the selection control signal input terminal.

Preferably, the source driving circuit further comprises a digital-to-analog converter, wherein the digital-to-analog converter has an input terminal configured to receive a digital data voltage signal and an output terminal connected to the non-inverting input terminal of the first operational amplifier, and the digital-to-analog converter is configured to convert the digital data voltage signal into an analog data voltage signal.

Preferably, the first operational amplifier comprises a first transistor to a ninth transistor and a storage capacitor, wherein the first transistor has a first electrode connected to a first electrode of the second transistor, a second electrode connected to a first electrode of the third transistor, and a control electrode connected to the non-inverting input terminal of the first operational amplifier;

the second transistor has the first electrode further connected to a second electrode of the fifth transistor, a second electrode connected to a first electrode of the fourth transistor, and a control electrode connected to the inverting input terminal of the first operational amplifier;

the third transistor has the first electrode further connected to a control electrode thereof, a second electrode connected to a low power supply terminal, and the control electrode further connected to a control electrode of the fourth transistor;

the fourth transistor has the first electrode further connected to a first terminal of the storage capacitor, and a second terminal connected to the low power supply terminal, wherein the storage capacitor has a second terminal connected to the output terminal of the first operational amplifier;

the fifth transistor has a first electrode connected to a high power supply terminal, the second electrode further connected to the first electrode of the first transistor and the first electrode of the second transistor, and a control electrode connected to a control electrode of the eighth transistor;

the sixth transistor has a first electrode connected to the high power supply terminal, a second electrode connected to a first electrode of the seventh transistor and the output terminal of the first operational amplifier, and a control electrode connected to the control electrode of the fifth transistor, the control electrode of the eighth transistor and a second electrode of the eighth transistor;

the seventh transistor has the first electrode further connected to the second terminal of the storage capacitor and the output terminal of the first operational amplifier, a second electrode connected to the low power supply terminal, and a control electrode connected to the first terminal of the storage capacitor;

the eighth transistor has a first electrode connected to the high power supply terminal, the second electrode further connected to a first electrode of the ninth transistor, and the control electrode connected to the second electrode thereof and the control electrode of the fifth transistor; and the ninth transistor has the first electrode connected to the second electrode of the eighth transistor and a second electrode connected to a control electrode thereof and the low power supply terminal.

Preferably, the output selection unit comprises an N-type transistor and a P-type transistor, wherein one of the N-type transistor and the P-type transistor has a first electrode connected to the data voltage signal input terminal of the output selection unit, and the other of the N-type transistor and the P-type transistor has a first electrode connected to the reference voltage signal input terminal of the output selection unit, and both of the N-type transistor and the P-type transistor have respective second electrodes connected with each other and connected to the output terminal of the source driving circuit, and respective control electrodes connected with each other and connected to the selection control signal input terminal of the output selection unit.

Further, preferably, the digital-to-analog converter comprises 2n resistors connected in series and multiple stages of logic switches, wherein n is an integer greater than or equal to 1; and each stage of logic switches comprises at least one logic switch, and each logic switch in a first stage of logic switches corresponds to a resistor and has an input terminal connected to a first terminal of the corresponding resistor, for each stage of logic switches, each logic switch in a next stage of logic switches has an input terminal connected to output terminals of corresponding two adjacent logic switches in this stage of logic switches, and any two adjacent logic switches are controlled using different logic levels.

The technical solutions for solving the technical problem of the present disclosure are to provide a source driving device, comprising a plurality of the source driving circuits described above.

Preferably, the source driving device further comprises a second operational amplifier, wherein the second operational amplifier has a non-inverting input terminal configured to receive a reference voltage signal, an inverting input terminal connected to an output terminal thereof, and the output terminal further connected to the reference voltage signal input terminal of the output selection unit, and the second operational amplifier is configured to amplify the reference voltage signal and output the amplified reference voltage signal to the reference voltage signal input terminal of the output selection unit.

Further, preferably, the second operational amplifier has the same structure as that of the first operational amplifier.

The technical solutions for solving the technical problem of the present disclosure are to provide a display panel, comprising the source driving device described above.

The technical solutions for solving the technical problem of the present disclosure are to provide a display device, comprising the display panel described above.

The present disclosure has the following beneficial effects:

In the source driving circuit according to the present disclosure, a suitable reference voltage source is selected so that a suitable reference voltage signal is output by the reference voltage source. The first operational amplifier only amplifies the analog data voltage signal without amplifying the reference voltage signal, so that the power consumption generated by the first operational amplifier only results from the amplification of the analog data voltage signal. As a result, compared with conventional solutions, the first operational amplifier according to the present disclosure has low power consumption, and therefore generates less heat. Consequently, it does not cause the problem that the source driving circuit has excessive high temperature and a shortened lifetime. Similarly, the source driving device, the display panel and the display device according to the present disclosure have low power consumption and a long lifetime.

DETAILED DESCRIPTION

In order to enable those skilled in the art to better understand the technical solutions of the present disclosure, the present disclosure will be described in further detail below with reference to accompanying drawings and specific embodiments.

Figure 1:
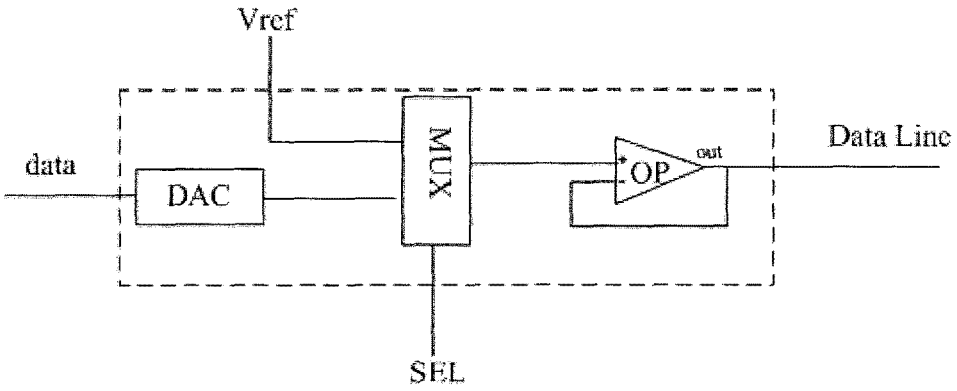
Fig. 1 (PRIOR ART)
FIG. 1 is an internal circuit diagram of a conventional source driving chip.
Figure 2:
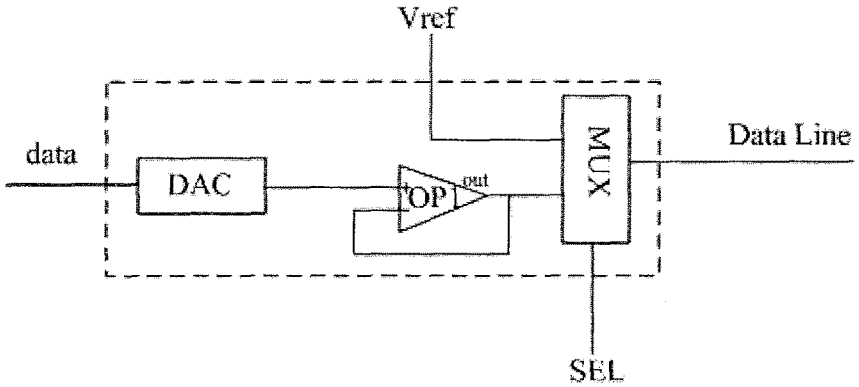
FIG. 2 is a circuit diagram of a source driving circuit according to an embodiment of the present disclosure.

As shown in FIG. 2, the embodiments of the present disclosure provide a source driving circuit, comprising a first operational amplifier OP1 and an output selection unit MUX, wherein the first operational amplifier OP1 has a non-inverting input terminal configured to receive an analog data voltage signal, an inverting input terminal connected to an output terminal thereof, and the output terminal further connected to a data voltage signal input terminal of the output selection unit MUX and configured to amplify the analog data voltage signal, and output the amplified analog data voltage signal to the data voltage signal input terminal of the output selection unit MUX; and the output selection unit MUX further has a reference voltage signal input terminal and a selection control signal input terminal, and the output selection unit MUX is configured to selectively output the amplified analog data voltage signal and a reference voltage signal Vref input from the reference voltage signal input terminal to a data line under the control of a selection control signal SEL input from the selection control signal input terminal.

In the source driving circuit according to the present embodiment, a suitable reference voltage source may be selected so that a suitable reference voltage signal Vref is output by the reference voltage source. The first operational amplifier OP1 only amplifies the analog data voltage signal without amplifying the reference voltage signal Vref, so that the power consumption generated by the first operational amplifier OP1 only results from the amplification of the analog data voltage signal. As a result, compared with conventional solutions, the first operational amplifier OP1 according to the present embodiment has low power consumption, and therefore generates less heat. Consequently, it does not cause the problem that the source driving circuit has excessive high temperature and a shortened lifetime.

Preferably, the source driving circuit according to the present embodiment may further comprise a digital-to-analog converter DAC, wherein the digital-to-analog converter DAC has one terminal (an input terminal) configured to receive a digital data voltage signal data and the other terminal (an output terminal) connected to the non-inverting input terminal of the first operational amplifier OP1, and the digital-to-analog converter DAC is configured to convert the digital data voltage signal data into an analog data voltage signal, and output the analog data voltage signal to the non-inverting input terminal of the first operational amplifier OP1.

Figure 4:
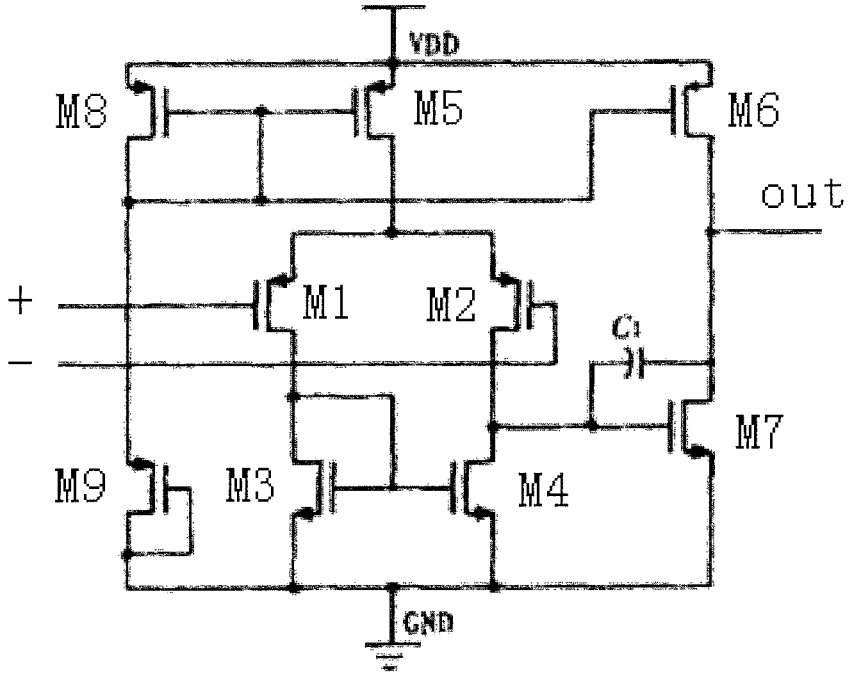
FIG. 4 is a circuit diagram of a first operational amplifier in a source driving circuit according to an embodiment of the present disclosure.

Specifically, as shown in FIG. 4, the first operational amplifier OP1 according to the present embodiment may comprise a first transistor M1 to a ninth transistor M9 and a storage capacitor C1, wherein the first transistor M1 has a first electrode connected to a first electrode of the second transistor M2, a second electrode connected to a first electrode of the third transistor M3, and a control electrode connected to the non-inverting input terminal of the first operational amplifier OP1; the second transistor M2 has the first electrode further connected to a second electrode of the fifth transistor M5, a second electrode connected to a first electrode of the fourth transistor M4, and a control electrode connected to the inverting input terminal of the first operational amplifier OP1; the third transistor M3 has the first electrode further connected to a control electrode thereof, a second electrode connected to a low power supply terminal, and the control electrode further connected to a control electrode of the fourth transistor M4; the fourth transistor M4 has the first electrode further connected to a first terminal of the storage capacitor C1, and a second terminal connected to the low power supply terminal, wherein the storage capacitor C1 has a second terminal connected to the output terminal of the first operational amplifier OP1; the fifth transistor M5 has a first electrode connected to a high power supply terminal, the second electrode further connected to the first electrode of the first transistor M1 and the first electrode of the second transistor M2, and a control electrode connected to a control electrode of the eighth transistor M8; the sixth transistor M6 has a first electrode connected to the high power supply terminal, a second electrode connected to a first electrode of the seventh transistor M7 and the output terminal of the first operational amplifier OP1, and a control electrode connected to the control electrode of the fifth transistor M5, the control electrode of the eighth transistor M8 and a second electrode of the eighth transistor M8; the seventh transistor M7 has the first electrode further connected to the second terminal of the storage capacitor C1 and the output terminal of the first operational amplifier OP1, a second electrode connected to the low power supply terminal, and a control electrode connected to the first terminal of the storage capacitor C1; the eighth transistor M8 has a first electrode connected to the high power supply terminal, the second electrode further connected to a first electrode of the ninth transistor M9, and the control electrode connected to the second electrode thereof and the control electrode of the fifth transistor M5; and the ninth transistor M9 has the first electrode connected to the second electrode of the eighth transistor M8 and a second electrode connected to a control electrode thereof and the low power supply terminal.

Of course, the first operational amplifier OP1 according to the present embodiment is not limited to the above-described structure, and may also have structures known to those skilled in the art, provided that it has a corresponding signal amplification function.

Figure 5:
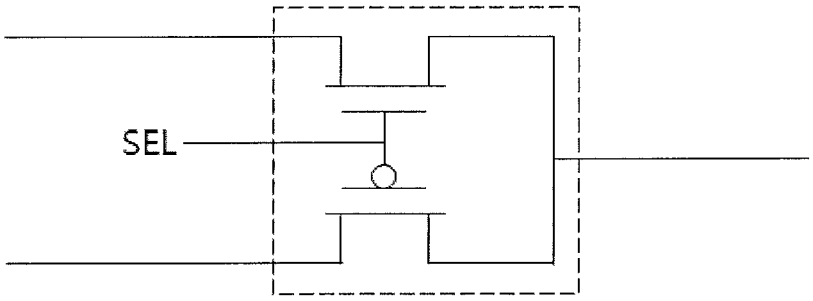
FIG. 5 is a circuit diagram of an output selection unit in a source driving circuit according to an embodiment of the present disclosure.

As shown in FIG. 5, the output selection unit MUX according to the present embodiment may comprise an N-type transistor and a P-type transistor, wherein one of the N-type transistor and the P-type transistor has a first electrode connected to the data voltage signal input terminal of the output selection unit MUX, and the other of the N-type transistor and the P-type transistor has a first electrode connected to the reference voltage signal input terminal of the output selection unit MUX, and both of the N-type transistor and the P-type transistor have respective second electrodes connected with each other and connected to the output terminal (i.e., the output terminal of the source driving circuit) of the source driving circuit MUX, and have respective control electrodes connected with each other and connected to the selection control signal input terminal of the output selection unit MUX.

Specifically, as the N-type transistor and the P-type transistor are controlled using different logic level signals, the output selection unit MUX may selectively output the analog data voltage signal or the reference voltage signal Vref.

Figure 6:
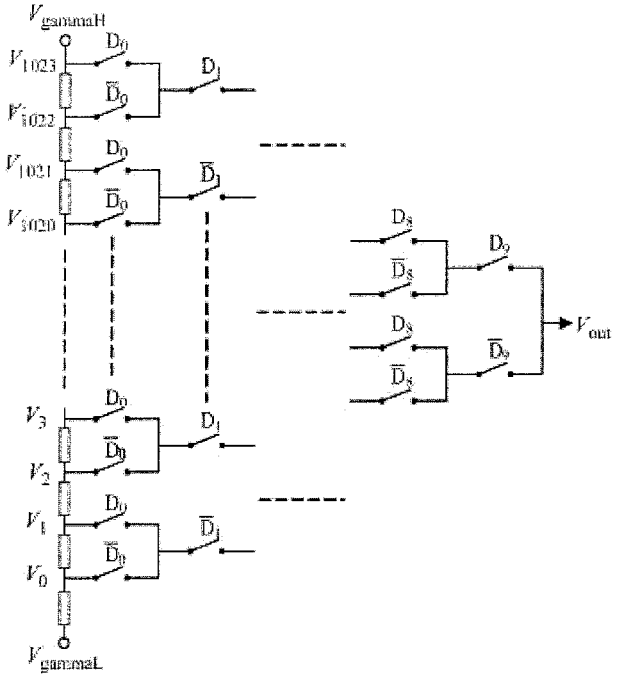
FIG. 6 is a circuit diagram of a digital-to-analog converter in a source driving circuit according to an embodiment of the present disclosure.

As shown in FIG. 6, the digital-to-analog converter DAC according to the present embodiment may comprise 2n (n is an integer greater than or equal to 1) resistors connected in series and multiple stages of logic switches; wherein each stage of logic switches comprises at least one logic switch, and each logic switch in a first stage of logic switches corresponds to a resistor and is connected to a same terminal (for example, a first terminal or a second terminal) of corresponding resistor, for each stage of logic switches, each logic switch in a next stage of logic switches has an input terminal connected to output terminals of corresponding two adjacent logic switches in this stage of logic switches, and any two adjacent logic switches are controlled using different logic levels. Obviously, a number of switches in the next stage of logic switches is a half of a number of switches in the last stage of logic switches.

It should be illustrated that the digital-to-analog converter DAC shown in FIG. 6 is a digital-to-analog converter DAC which is illustrated by taking n=10 as an example. Of course, the digital-to-analog converter DAC according to the present embodiment is not limited to the above-described structure, and may also have structures known to those skilled in the art.

It should be illustrated that the source driving circuit according to the present embodiment is actually integrated into a chip (for example, a source driving chip), and as the power consumption of the first operational amplifier OP1 is reduced, the generated heat is also reduced, and thus it does not cause the chip to have excessive high temperature, thereby enabling the chip to have a longer lifetime.

Figure 3:
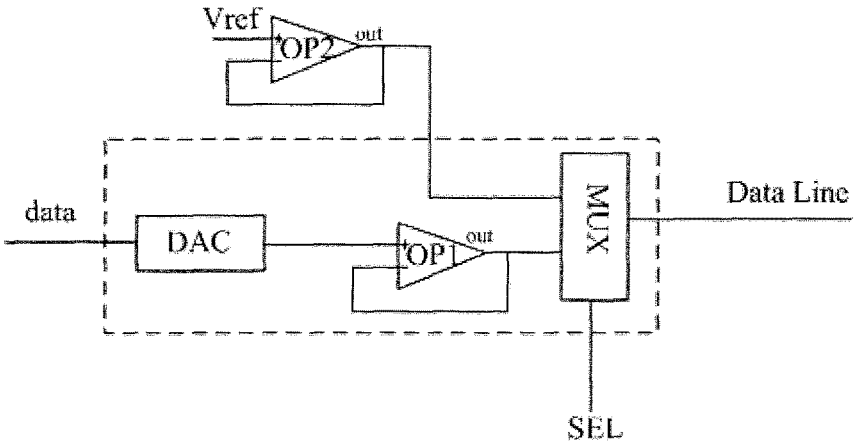
FIG. 3 is a circuit diagram of a source driving device according to an embodiment of the present disclosure.

As shown in FIG. 3, the embodiments of the present disclosure further provide a source driving device comprising a plurality of the source driving circuits described above, for driving a plurality of data lines on a display panel through a plurality of source driving circuits.

When the reference voltage signal Vref is insufficient to supply a desired data driving signal, it needs to amplify the reference voltage signal Vref. Therefore, it is preferable that the source driving device according to the present embodiment may further comprise a second operational amplifier OP2. The second operational amplifier OP2 has a non-inverting input terminal configured to receive a reference voltage signal, an inverting input terminal connected to an output terminal thereof, and the output terminal further connected to the reference voltage signal input terminal of the output selection unit, and the second operational amplifier is configured to amplify the reference voltage signal Vref and output the amplified reference voltage signal Vref to the reference voltage signal input terminal of the output selection unit MUX.

In the present embodiment, a manner in which the second operational amplifier OP2 is added outside the source driving circuit is used, which does not increase the power consumption of the source driving circuit, and thereby does not influence the performance of the source driving circuit.

The second operational amplifier OP2 may have the same structure as that of the first operational amplifier OP1 and will not be described in detail here. Of course, the second operational amplifier OP2 may have a different structure from that of the first operational amplifier OP1, which may be other structures known to those skilled in the art, provided that it has a corresponding signal amplification function.

The embodiments of the present disclosure further provide a display panel, comprising the source driving device described above.

The embodiments of the present disclosure further provide a display device comprising the display panel described above. The display device may be any product or component having a display function such as a mobile phone, a tablet computer, a television, a display, a notebook computer, a digital photo frame, a navigator etc.

Of course, the display device according to the present embodiment may further comprise other conventional structures, such as a power supply unit, a display driving unit etc., which will not be described in detail here.

It can be understood that the above embodiments are merely exemplary implementations for explaining the principle of the present disclosure, but the present disclosure is not limited thereto. It will be apparent to those skilled in the art that various changes and modifications can be made without departing from the spirit and essence of the disclosure, and all these changes and modifications are also construed to be within the protection scope of the present disclosure.

I claim:

1. A source driving circuit, comprising a first operational amplifier; and an output selection unit, wherein the first operational amplifier has a non-inverting input terminal configured to receive an analog data voltage signal, an inverting input terminal connected to an output terminal thereof, and the output terminal further connected to a data voltage signal input terminal of the output selection unit, and the first operational amplifier is configured to amplify the analog data voltage signal, wherein the output selection unit has a reference voltage signal input terminal and a selection control signal input terminal, and the output selection unit is configured to selectively output the amplified analog data voltage signal and a reference voltage signal input from the reference voltage signal input terminal to a data line under control of a selection control signal input from the selection control signal input terminal, and wherein the first operational amplifier comprises a first transistor to a ninth transistor and a storage capacitor, and wherein the first transistor has a first electrode connected to a first electrode of the second transistor, a second electrode connected to a first electrode of the third transistor, and a control electrode connected to the non-inverting input terminal of the first operational amplifier;

the second transistor has the first electrode further connected to a second electrode of the fifth transistor, a second electrode connected to a first electrode of the fourth transistor, and a control electrode connected to the inverting input terminal of the first operational amplifier;

the third transistor has the first electrode further connected to a control electrode thereof, a second electrode connected to a low power supply terminal, and the control electrode further connected to a control electrode of the fourth transistor;

the fourth transistor has the first electrode further connected to a first terminal of the storage capacitor, and a second terminal connected to the low power supply terminal, wherein the storage capacitor has a second terminal connected to the output terminal of the first operational amplifier;

the fifth transistor has a first electrode connected to a high power supply terminal, the second electrode further connected to the first electrode of the first transistor and the first electrode of the second transistor, and a control electrode connected to a control electrode of the eighth transistor;

the sixth transistor has a first electrode connected to the high power supply terminal, a second electrode connected to a first electrode of the seventh transistor and the output terminal of the first operational amplifier, and a control electrode connected to the control electrode of the fifth transistor, the control electrode of the eighth transistor and a second electrode of the eighth transistor;

the seventh transistor has the first electrode further connected to the second terminal of the storage capacitor and the output terminal of the first operational amplifier, a second electrode connected to the low power supply terminal, and a control electrode connected to the first terminal of the storage capacitor;

the eighth transistor has a first electrode connected to the high power supply terminal, the second electrode further connected to a first electrode of the ninth transistor, and the control electrode connected to the second electrode thereof and the control electrode of the fifth transistor; and the ninth transistor has the first electrode connected to the second electrode of the eighth transistor and a second electrode connected to a control electrode thereof and the low power supply terminal.

2. The source driving circuit according to claim 1, further comprising a digital-to-analog converter, wherein the digital-to-analog converter has an input terminal configured to receive a digital data voltage signal and an output terminal connected to the non-inverting input terminal of the first operational amplifier, and the digital-to-analog converter is configured to convert the digital data voltage signal into an analog data voltage signal.

3. The source driving circuit according to claim 2, wherein the output selection unit comprises an N-type transistor and a P-type transistor, and wherein one of the N-type transistor and the P-type transistor has a first electrode connected to the data voltage signal input terminal of the output selection unit, and the other of the N-type transistor and the P-type transistor has a first electrode connected to the reference voltage signal input terminal of the output selection unit, and both of the N-type transistor and the P-type transistor have respective second electrodes connected with each other and further connected to the output terminal of the source driving circuit, and respective control electrodes connected with each other and further connected to the selection control signal input terminal of the output selection unit.

4. The source driving circuit according to claim 2, wherein the digital-to-analog converter comprises 2n resistors connected in series and multiple stages of logic switches, wherein n is an integer greater than or equal to 1; and each stage of logic switches comprises at least one logic switch, and each logic switch in a first stage of logic switches corresponds to a resistor and has an input terminal connected to a first terminal of corresponding resistor, for each stage of logic switches, each logic switch in a next stage of logic switches has an input terminal connected to output terminals of corresponding two adjacent logic switches in this stage of logic switches, and any two adjacent logic switches are controlled using different logic levels.

5. A source driving device, comprising a plurality of the source driving circuits according to claim 2.

6. The source driving device according to claim 5, further comprising a second operational amplifier, wherein the second operational amplifier has a non-inverting input terminal configured to receive a reference voltage signal, an inverting input terminal connected to an output terminal thereof, and the output terminal further connected to the reference voltage signal input terminal of the output selection unit, and the second operational amplifier is configured to amplify the reference voltage signal and output the amplified reference voltage signal to the reference voltage signal input terminal of the output selection unit.

7. The source driving device according to claim 6, wherein the second operational amplifier has a same structure as that of the first operational amplifier.

8. The source driving circuit according to claim 1, wherein the output selection unit comprises an N-type transistor and a P-type transistor, and wherein one of the N-type transistor and the P-type transistor has a first electrode connected to the data voltage signal input terminal of the output selection unit, and the other of the N-type transistor and the P-type transistor has a first electrode connected to the reference voltage signal input terminal of the output selection unit, and both of the N-type transistor and the P-type transistor have respective second electrodes connected with each other and further connected to the output terminal of the source driving circuit, and respective control electrodes connected with each other and further connected to the selection control signal input terminal of the output selection unit.

9. A source driving device, comprising a plurality of the source driving circuits according to claim 8.

10. The source driving device according to claim 9, further comprising a second operational amplifier, wherein the second operational amplifier has a non-inverting input terminal configured to receive a reference voltage signal, an inverting input terminal connected to an output terminal thereof, and the output terminal further connected to the reference voltage signal input terminal of the output selection unit, and the second operational amplifier is configured to amplify the reference voltage signal and output the amplified reference voltage signal to the reference voltage signal input terminal of the output selection unit.

11. A source driving device, comprising a plurality of the source driving circuits according to claim 1.

12. The source driving device according to claim 11, further comprising a second operational amplifier, wherein the second operational amplifier has a non-inverting input terminal configured to receive a reference voltage signal, an inverting input terminal connected to an output terminal thereof, and the output terminal further connected to the reference voltage signal input terminal of the output selection unit, and the second operational amplifier is configured to amplify the reference voltage signal and output the amplified reference voltage signal to the reference voltage signal input terminal of the output selection unit.

13. The source driving device according to claim 12, wherein the second operational amplifier has a same structure as that of the first operational amplifier.

14. A display panel, comprising the source driving device according to claim 11.

15. A display device, comprising the display panel according to claim 14.

* * * * *